US005145221A

United States Patent [19]

Pennebaker et al.

[11] Patent Number: 5,145,221

[45] Date of Patent: Sep. 8, 1992

[54] SLIDING LATCH LOCK

[75] Inventors: Ashley Pennebaker, Aurora; Duane R. Picht; Emerson Purkapile, both of Chicago, all of Ill.

[73] Assignee: Chicago Electrical Tool Company, Inc., Norcross, Ga.

[21] Appl. No.: 554,260

[22] Filed: Jul. 17, 1990

[51] Int. Cl.[5] ..... E05C 1/10

[52] U.S. Cl. ..... 292/175; 292/146; 292/DIG. 31; 292/DIG. 48

[58] Field of Search ..... 292/175, DIG. 30, DIG. 31, 292/244, 145, 146, 153, DIG. 48, DIG. 42, DIG. 64, DIG. 53, DIG. 50

[56] References Cited

U.S. PATENT DOCUMENTS

| | | | |
|---|---|---|---|
| 2,730,390 | 1/1956 | Atkinson | 292/145 |
| 3,169,788 | 2/1965 | Slan | 292/DIG. 48 |
| 3,266,275 | 8/1966 | Atkinson | 292/DIG. 31 |
| 3,371,511 | 3/1968 | Atkinson | 292/145 |
| 3,527,067 | 9/1970 | Atkinson | 292/175 |
| 3,557,917 | 1/1972 | Kaplan | 70/70 |
| 4,239,269 | 12/1980 | Chiang | 292/175 |
| 4,356,712 | 11/1982 | Bako | 70/69 |
| 4,545,225 | 10/1985 | Mihojevich | 292/153 |
| 4,641,506 | 2/1987 | Boucher | 292/153 |
| 4,669,765 | 6/1987 | Ullman | 292/153 |
| 4,850,624 | 7/1989 | Lee | 292/228 |
| 4,934,162 | 6/1990 | Rasch | 292/175 |

*Primary Examiner*—Renee S. Luebke
*Assistant Examiner*—D. Boucher
*Attorney, Agent, or Firm*—Willian Brinks Olds Hofer Gilson & Lione

[57] ABSTRACT

An apparatus for locking a case having a first part and a second part that close together along a first edge of the first part and a second edge of the second part, comprising a housing portion mountable in the first part adjacent the first edge, a latch portion positioned in the housing portion and capable of slidable movement within the housing portion from a first position to a second position displaced from the first position, and a biasing spring positioned between and adapted with respect to the housing portion and the latch portion to bias the latch portion into the first position. A catch is connected to the second part of the case and extends in a direction from the second edge of the second part toward the first edge of the first part. Further, the catch is positioned, aligned, and adapted with respect to the housing portion and the latch portion in the first part so that when the first edge of the first part and the second edge of the second part are closed together and the latch portion is in the first position, the latch portion engages the catch.

15 Claims, 3 Drawing Sheets

48
50
52
10
46
58
22
62
40
26
20
198
138
60
140
36
150
152
34
32
30
156
38
92
160
24
97
54
56
84
96
28
94
86
158
102
98
66
74
100
108
104

SLIDING LATCH LOCK

BACKGROUND OF THE INVENTION

This invention relates to a lock, and particularly to a lock especially suitable for use on luggage, suitcases, briefcases, and equipment cases.

Many types of locks are utilized for these applications. All of these locks, however, have at least one of the drawbacks of being either complex, requiring specialized assembly, not featuring a sliding latch or requiring one design for installation on the left, and another design for installation on the right, i.e. not having reversible utility.

It is a general object of the present invention to provide a sliding latch lock which has a minimum number of parts, yet provides secure and dependable locking.

Another object of the present invention is to provide a sliding latch lock which has snap-together assembly. This provides for quick assembly with a minimum of labor and further ensures that only a minimum number of parts are required.

A further object of the present invention is to provide a sliding latch lock which has reversible utility. By attaining this object, a single design may be used which can be mounted in either the right-hand or left-hand positions on a suitcase.

Other objects and advantages of the invention will become apparent upon reading the following detailed description, appended claims, and upon reference to the accompanying drawings.

SUMMARY OF THE INVENTION

According to the present invention, there is provided an apparatus for locking a case, the case having a first part and a second part that close together along a first edge of the first part and a second edge of the second part, the apparatus comprising a housing portion mountable in the first part adjacent the first edge, a latch portion positioned in the housing portion and capable of slidable movement within the housing portion from a first position to a second position displaced from the first position, and a biasing means positioned between and adapted with respect to the housing portion and the latch portion to bias the latch portion into the first position. A catch is connected to the second part of the case and extends in a direction from the second edge of the second part toward the first edge of the first part. Further, the catch is positioned, aligned, and adapted with respect to the housing portion and the latch portion in the first part so that when the first edge of the first part and the second edge of the second part of the case are closed together and the latch portion is in the first position, the latch portion engages the catch.

According to a further aspect of the invention, there may be provided a lock securable within the housing and operably adapted to interfere with the movement of the latch from the first position to the second position when the lock is in a closed position, and to allow movement of the latch portion to the second position when the lock is in an open position.

According to still another aspect of the invention, there is provided an apparatus for locking a case, the case having a first part and a second part that close together along a first edge of the first part and a second edge of the second part, the apparatus comprising an elongate housing portion mountable in the first part adjacent the first edge, at least two latch portions positioned in the elongate housing portion each capable of slidable movement within the elongate housing portion from a first position to a second position displaced from the first position, and at least two biasing means positioned, one associated with each of the latch portions, and located between and adapted with respect to the housing portion and an associated latch portion to bias the latch portion into the first position. At least two catches are connected to the second part of the case and extend in a direction from the second edge of the second part toward the first edge of the first part. Further, the catches are positioned, aligned, and adapted with respect to the housing portion and each of the latch portions in the first part so that when the first edge of the first part and the second edge of the second part are closed together and each of the latch portions is in a first position, each of the latch portions engages a respective catch.

DETAILED DESCRIPTION OF THE PRESENTLY PREFERRED EMBODIMENT

Referring to FIGS. 1–5, there is depicted a first embodiment of the present invention generally indicated as a sliding lock 10. The sliding lock 10 may preferably be used with a case, such as a suitcase, briefcase, piece of luggage, carrying case, storage case or the like. It is understood that use of the present invention with a case of the type mentioned above, or of any other type, requires the provision of a mounting location, such as an opening, in the shell of the case of a size and dimension suitable for the positioning therewithin of the sliding lock 10.

Figures 1, 2, 3:
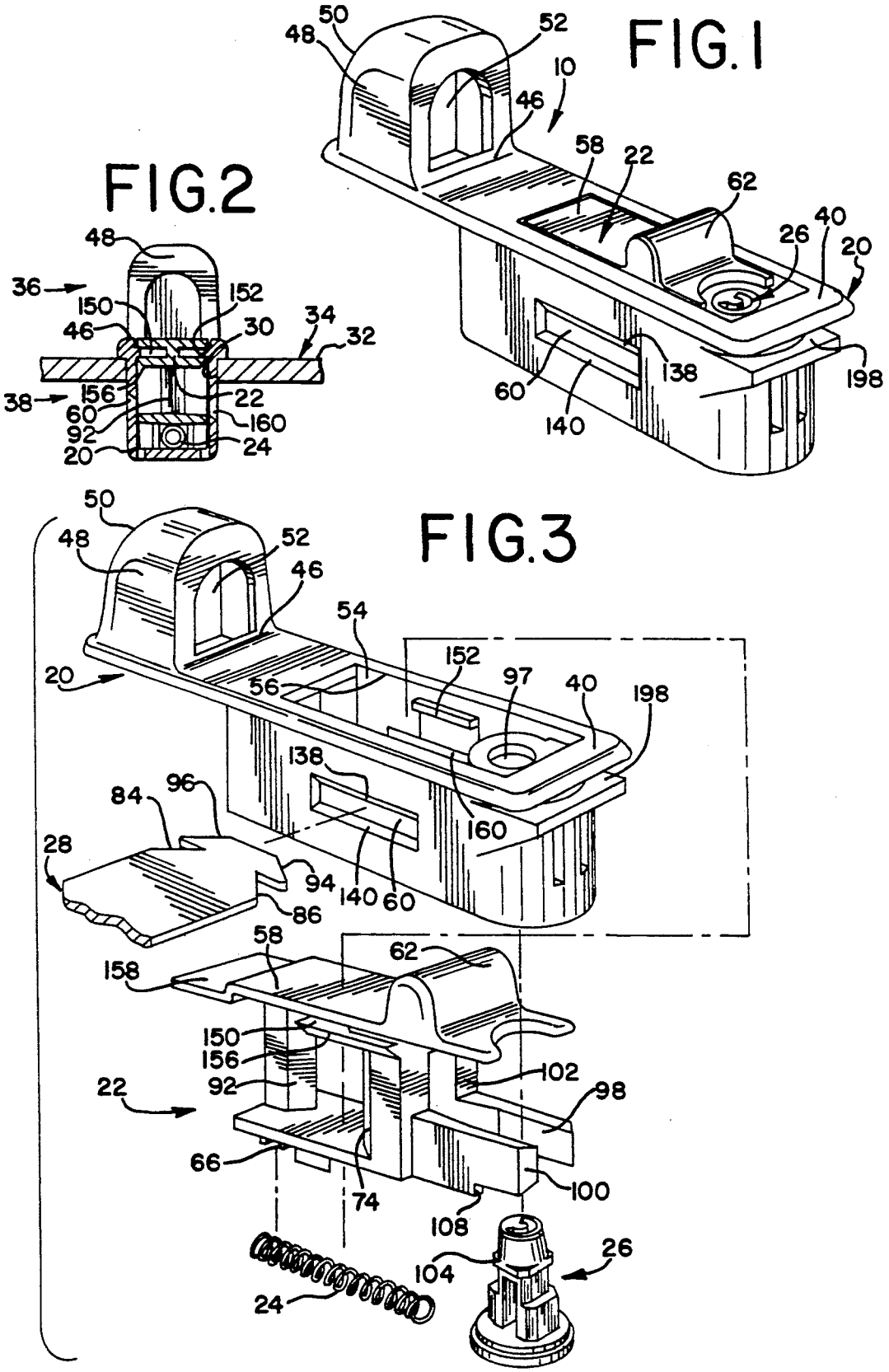
FIG. 1 is a perspective view of a first embodiment of the assembled invention.
FIG. 2 is cross-sectional front view of the embodiment depicted in FIG. 1.
FIG. 3 is an exploded view of the embodiment depicted in FIG. 1.

In FIG. 1, the sliding lock 10 is shown assembled, but not installed into a case of the type mentioned above. In a preferred embodiment of the present invention, the sliding lock is comprised of a minimal number of parts which are easy to produce and assemble together to minimize costs of construction. In a first preferred embodiment, the sliding lock 10 is comprised of a housing portion 20, a latch portion 22, a biasing means 24, and a lock 26 that when assembled are located in a first side of a case and a catch 28 that is located in the second side of the case.

Referring to FIG. 2, the sliding lock 10 is depicted installed in an opening 30 in a surface 32 of a shell of a case 34. When so installed in the opening 30, a portion 36 of the sliding lock 10 extends above the surface 32 of the case and a portion 38 is beneath the surface 32. The portion 38 beneath the surface 32 may be enclosed by a part of the shell of the case or may be enclosed by means of a cover disposed over the bottom of the sliding lock, or may be exposed with no cover. In all mounting positions, however, the catch opening 60 must be exposed to enable the catch 28 to engage the latch 22 in the slide housing 20.

The housing portion 20 is preferably formed of a single piece of molded plastic. In this embodiment, the housing portion is approximately 4 inches long, ¾ inches wide, and ¾ inches deep.

In this embodiment, the housing portion includes an upper portion 40 which corresponds to the portion 36 of the sliding lock 10 extending above the surface 32 of the case and a lower portion 42 which corresponds to the portion 38 of the sliding lock 10 that extends beneath the surface 32 of the case. The upper portion 40 of the housing portion 20 further includes an upper housing surface 46.

Figure 4:
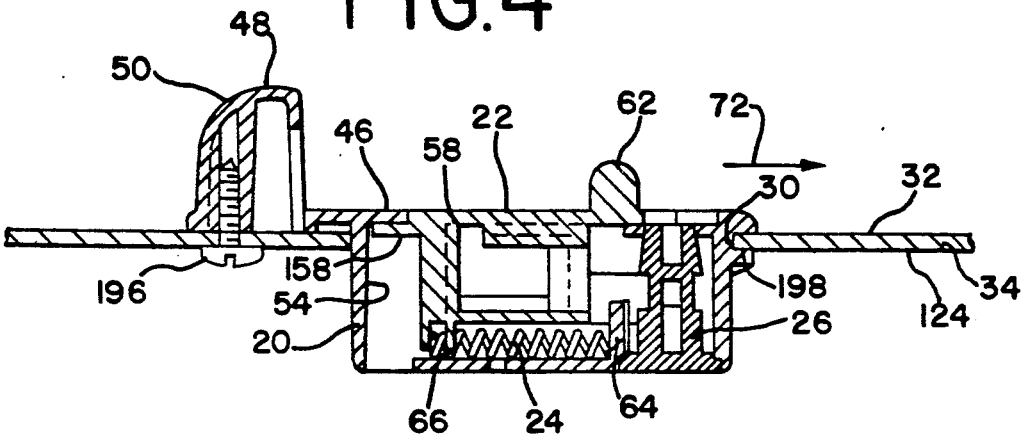
FIG. 4 is a cross-sectional side view of the embodiment depicted in FIG. 1.

As seen in FIGS. 3 and 4, located on the upper portion 40 of the housing portion 20 and preferably forming a part of the upper housing surface 46 is a handle lug 48. In this embodiment, the handle lug 48 on the housing includes a rounded portion 50 facing in one direction and a socket 52 facing in the opposite direction. The handle lug 48 depicted herein is a single lug which would be used in conjunction with another handle lug (not shown) to form a pair of handle lugs to which a handle can be attached to facilitate the carrying of the case. Through these lugs, a handle having a pair of pins oriented toward each other can be connected to the case. In the preferred embodiment, the handle lug is formed as an integral part of the sliding lock. In this configuration then, two oppositely orientated sliding locks are utilized to connect both ends of a handle to the case. In another embodiment, the handle lug is separate from the sliding lock. In this embodiment the separate handle lug may be fastened to the case by a self-threading screw. It is not necessary to connect the separate handle lug to the sliding lock itself. Instead, the separate handle lug may be connected to the case wherever the dimensions of the handle dictate that it be mounted.

Figure 8:
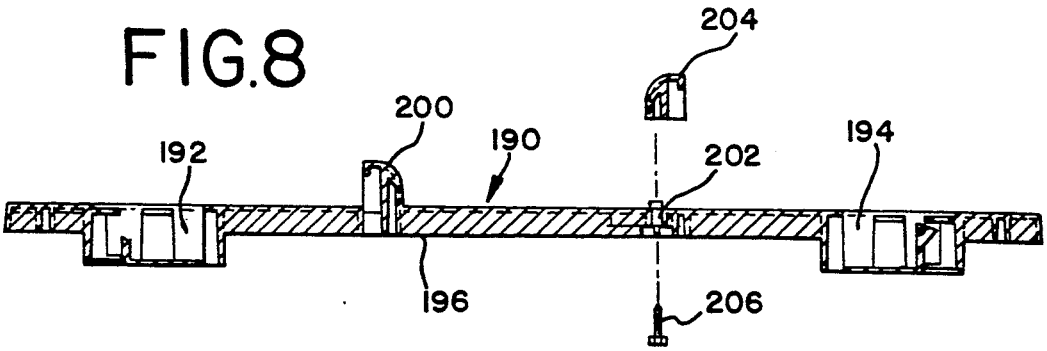
FIG. 8 is a cross-sectional view of another preferred embodiment of the present invention.

In still another embodiment, as seen in FIG. 8, two sliding locks 192 and 194 are integrally formed along a bar member 196. An integral handle lug 200 as well as a separate handle lug 204 are used to connect the handle to the case. The separate handle lug 204 is fastened to the bar 196 with a self-threading screw 206. In sum, although the formation of the handle lug integral to the sliding latch 10 is part of the preferred embodiment it is understood that the sliding lock 10 may be constructed without the provision of an integral handle lug.

Referring to FIG. 3, the housing portion 20 includes a latch chamber 54 located in the interior thereof into which the latch portion 22 can be positioned. The latch portion 22 is positioned into the housing 20 through the opening 56 on the upper surface 46 of the housing. At least one additional opening, the catch opening 60, is formed in the lower portion of the housing portion 20 to provide access to the latch chamber 54 for the catch 28. The catch opening 60 may preferably be a generally elongate slot located in the lower portion of the housing.

The latch portion 22 is preferably formed of a single piece of molded plastic. The actuator portion 58 of the latch portion 22 is preferably a flat surface having a nub 62 formed thereon and extending upward to facilitate moving the latch portion 22.

Figure 5:
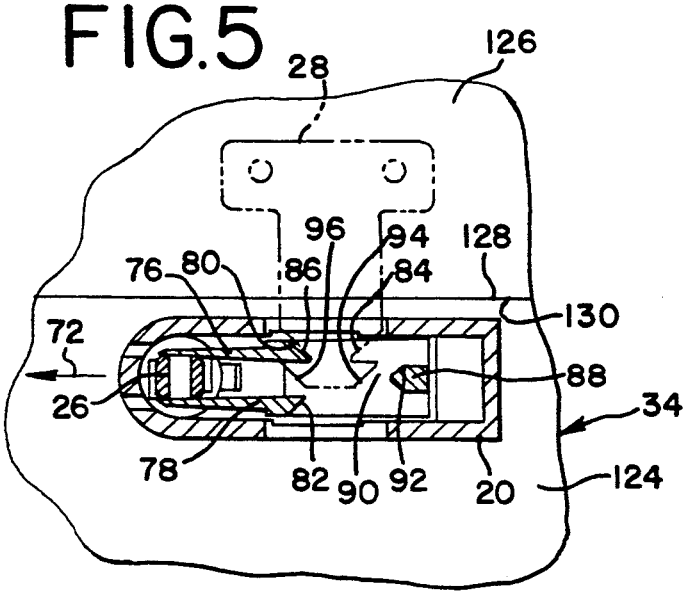
FIG. 5 is a cross-sectional top view of the embodiment depicted in FIG. 1.

The latch portion 22 is positioned in the housing portion 20 with the biasing means 24 positioned between and bearing upon a surface 64 of the housing portion 20 and a surface 66 of the latch portion 22 as seen FIG. 4. The biasing means bearing surfaces 64 and 66 of the housing portion 20 and the latching portion 22, respectively, are preferably located on the lowermost portions thereof. The biasing means 24 functions to bias the latch portion 22 to a first (i.e. a "locking") position in the housing portion 20. The first position is depicted in FIGS. 1, 4, and 5. The latch portion 22 is slidable in the housing portion 20 to a second (i.e. a "releasing") position. Sliding of the latch portion 22 in the housing portion 20 may be effected by a force sufficient to overcome the biasing means 24 and applied to the actuator portion 58 of the latch portion 22, preferably to the nub 62 thereupon, in the direction indicated by the arrow 72. The biasing means 24 is preferably a coil spring.

The latch portion 22 further includes a catch engaging means 74. The catch engaging means 74 in the preferred embodiment is a pair of arms 76 and 78 as seen in FIG. 5. The arms 76 and 78 are aligned adjacent to the catch opening 60 so that when the catch 28 is positioned in the housing portion 20 and the latch portion 22 is in the first position (i.e. locking), the catch 28 engages one of the arms 76 or 78 at surfaces 80 or 82 respectively. When the latch portion 22 is in the second position, the catch engaging means 74 does not engage the catch 28 and catch 28 can be released. The surfaces 80 and 82 of the arms 76 and 78, respectively, are appropriately tapered to facilitate moving a catch 28 into engagement with the catch engaging means 74. The catch 28 includes notches 84 and 86 associated and aligned with the catch engaging means 74 so that when the catch 28 is positioned into the opening 60 in the housing portion 20, one of the arms, e.g 76, retains and engages one of the notches. e.g. 86. As may be apparent from the Figures, the catch 28 only engages one of the arms 76 or 78 of the catch remaining means 74 on-the latch portion 22. The function of the other arm will be explained below.

In addition to the catch engaging means 74, the latch portion further includes a catch releasing means 88. The catch releasing means 88 serves to facilitate releasing the catch 28 from engagement with the catch engaging means 74 of the latch portion 22 and directing the catch 28 out of the slide housing. In the preferred embodiment, as seen in FIG. 5, the catch releasing means 88 is positioned directly adjacent the catch engaging means 74 across from the area 90 which the catch 28 occupies when the catch 28 is engaged in the latch and housing portions. The catch releasing means 88 includes at least one tapered surface 92 facing the area 90. When the latch portion 22 is moved from the first position to the second position in the housing portion 20, the tapered surface 92 of the catch releasing means 88 bears on a surface 94 of the catch 28 thereby facilitating the movement of the catch 28 out of the latch portion 22 and housing portion 20.

In addition to the housing portion 20, latch portion 22 and biasing means 24, the sliding lock 10 may also include the lock 26. The lock 26 is depicted in FIG. 6.

Figure 6:
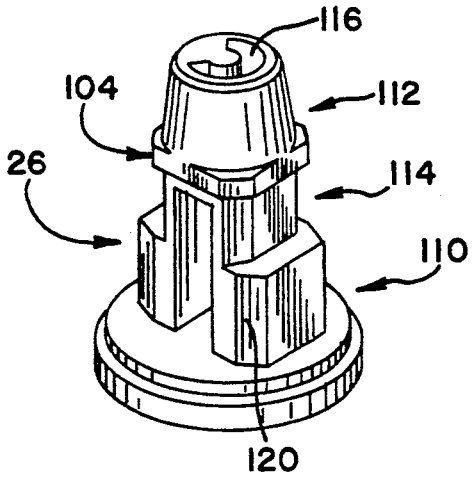
FIG. 6 is a perspective view of the lock portion of the invention.

Referring to FIG. 6, the lock 26 includes three areas: an upper area 112, a middle area 114 and a lower area 110. The upper area 112 is substantially cylindrical and contains the lock securing skirt 104. This skirt 104 engages the lock support prongs 98 and 100 and secures the lock 26 into the housing portion 20. The upper area 112 has a keyhold 116 permitting rotation of the lock 26 through the use of a corresponding key (not shown). The middle area 114 of the lock 26 is substantially square with flat sides and engages the lock support prongs 98 and 100. An indexing interaction is provided to the lock by the flat sides of middle area 114 which interact with the lock support prongs 98 and 100. The beveled corners 120 of the lock 26 provide clearance for the lock support prongs 98 and 100 in the slide housing 20 during the rotation of the lock into its locked and unlocked positions.

The lower area 110 of the lock 26 is rectangular as can be seen in FIG. 6. Through this rectangular configuration, when the lock 26 is rotated into one orientation the narrow dimension of the rectangle 122 will not interfere with the interference areas 108 on the latch 22. However, when the lock 26 is rotated ninety degrees into another position, the widest dimension of the rectangle 122 interfers with the interference areas 108 and blocks the movement of the latch portion 22 from the first position. Through this interference, the latch portion 22 is prevented from disengaging the catch and a locking of the latch is accomplished.

The lock 26 is positioned in the lock engaging means associated with the latch portion 22 and aperture 97 of the housing portion 20. In a preferred embodiment, the lock engaging means comprises first and second prongs 98 and 100 that extend from one end 102 of the latch portion 22. In this embodiment, the prongs 98 and 100 engage the lock 26 underneath a lock securing skirt 104. The prongs 98 and 100 also facilitate the locking feature of this embodiment of the invention specifically by means of interference areas 108 which are part of the lock support prongs 98 and 100. As discussed above, the lock 26 is dimensioned so that by rotation thereof, the locking interference areas 108 engage with the lock 26 at a lower area 110 thereof thus preventing the latch portion 22 from movement from the first position. This prevents the latch portion 22 from disengaging the catch 28 and in this manner locking of the latch portion 22 into the first position in the housing portion 20 is obtained.

Referring to FIG. 5, the sliding lock 10 is installed in the case 34 in a first part 124 thereof that closes against a second part 126 along a first edge 128 of the first part 124 and a second edge 130 of the second part 126. If the present invention is being used in a suitcase, the first and second parts will be the shell halves which are hinged together so that they may be closed and locked together along the edges of each part opposite the hinge. The sliding lock 10 is installed in the opening 30 located in the first part 124 of the case 34 close to the edge 128.

As seen in FIG. 4, the sliding lock 10 is mounted into shell 124 through the use of a groove 198 into which shell 124 corresponds. The sliding lock 10 is further mounted with the use of a self-tapping screw 196 positioned in proximity to the handle lug 48.

The catch 28 is mounted to the second part 126 so that when it is engaged in the housing portion 20, the first part 124 of the case and the second part 126 of the case are held together and the case remains closed. The catch 28 is installed in the second part 126 beneath the surface 32 thereof extending from the edge 130 of the second part 126 in the direction toward the first part 124. The catch 28 is mounted and installed in the second part 126 directly adjacent and aligned with the opening 60 in the housing portion 20 of the sliding lock 10. As mentioned above, the catch 28 includes surfaces 94 and 96 that engage at least one of the arms 76 and 78 to secure the catch 28 into the housing portion 20. The opening 60 includes beveled surfaces 138 and 140 to facilitate alignment of the catch 28 into the opening 60 of the housing portion 20.

In the preferred embodiment, the sliding lock 10 is assembled prior to installation in the opening 30 of the case 34. The portions that are preferably assembled include the housing portion 20, the latch portion 22, the biasing means 24 and the lock 26. In the preferred embodiment of the invention, these parts are self-fastening, i.e. they can be assembled without the use of separate fasteners.

To assemble the preferred embodiment, the latch portion 22 is inserted into the housing portion 20 through the opening 54. Attached to the latch portion 22 when it is inserted into the housing 20 is one end of the biasing means 24. Specifically, one end of the biasing means 24 is placed on the biasing means bearing surface 66 of the latch portion 22. During the insertion of the latch portion 22 into the housing portion 20, the other end of the biasing means 24 engages with the housing portion 20 at the biasing means bearing surfaces 64 of the housing portion 20.

According to this embodiment, the latch portion 22 is slidably secured inside the housing portion 20 through the use of a groove 150 formed longitudinally in the latch portion 22 and a corresponding tongue 152 formed on the housing portion 20. As depicted in FIG. 2, latch portion 22 nests into the housing portion 20 and is secured therein by tongue 152 and grooves 150. The tongue 152 and groove 150 provide for mounting the latch portion 22 so that it is fixed within the housing 20 and yet can still be slid from the first position to the second position. Moreover, the tongue 152 and grooves 150 are dimensioned so that during assembly the latch portion 22 may be snapped into place. Further facilitating this ease of assembly is the provision of a bevel 156 on the lower lip of the groove 150. Thus, the latch portion 22 and the housing portion 20 can be self-fastening.

Also securing the latch portion 22 into the housing portion 20 is a rear slide housing engagement means 158. After insertion, the rear slide housing engagement means 158 engages the housing portion 20 underneath the housing surface 46 in all positions except the second position, to further ensure the latch portion 22 from coming out of the housing portion 20.

After the latch portion 22 is snapped down into place in the housing portion 20, the biasing means 24 provides a bias to the latch portion 22 to the first position. The latch portion 22 is moved between its engaged and disengaged positions through the use of the actuator 58.

Next, the lock 26 is inserted from underneath the slide housing 20 into the slide housing 20 so that the prongs 98 and 100 engage the lock just underneath the lock securing skirt 104. In the preferred embodiment the lock 26 is held between the lock support prongs 98 and 100 which secure its mounting into the housing portion 20. The lock support prongs 98 and 100 and the lock 26 are dimensioned so that during assembly the lock 26 may be snapped into place.

After assembly of the housing portion 20, the latch portion 22, the biasing means 24 and the lock 26, the sliding lock can be installed in the case. The installation may be made by means of mounting surfaces, such as tongues and grooves in the walls of the housing and the case as discussed above.

In another embodiment, this may be accomplished by use of pins 132 that extend down from the surface 46 of the housing portion 20. The assembly may then be affixed to the case by fastening means such as self-threading nuts 135 or the like.

In a preferred embodiment of the present invention, the sliding lock 10 is completely symmetrical about an axis along its length so that it can be used on either the left or right-hand side of a case, i.e. has reversible utility. Making the sliding lock completely symmetrical also minimizes the number of different parts necessary to produce and serves to reduce the construction costs.

In order to provide this symmetry, a second catch opening 160 is provided in the housing portion 20 directly opposite the first opening 60. When installed, only one of these two openings 60 or 160 would be used. However, inasmuch as the other opening would be covered by the shell of the case, its presence in no way detracts from the operation of the sliding lock 10.

A further feature included to achieve reversible utility is that the catch engaging means include a pair of arms 76 and 78. If opening 60 is used surface arm 76 will engage the catch and if opening 160 is used arm 78 will engage the catch.

Similarly, the catch releasing means 88 also is provided with a pair of slanted surfaces one of which will bear upon the catch and direct it out of the housing. The catch includes a first notch 84 and a second notch 86 to provide this symmetry of operation. After the sliding lock 10 is installed in a case, it may be operated to latch and lock the first and second portions of the case together.

Starting with the case open, the biasing means 24 biases the latch portion 22 into the first (i.e. locking) position in the housing portion 20. In order to close the case, the first and second parts of the case are brought together whereby the catch 28 is brought into the catch opening 60 in the housing portion 20 in the first part of the case. The catch 28 bears upon the catch retaining means 74 forcing it toward the second (i.e. releasing) position sufficiently so that the notch portion of the catch 28 may be engaged in catch retaining means 74. Alternately, a force may be applied to the actuator portion 58 to move it toward the second position sufficiently so that the catch 28 may be inserted into the housing portion 20 to engage the catch engaging portion 74 with the notch 86.

At this point, the case may be locked by turning the lock 26 ninety degrees by means of a key. The case is then locked.

In order to open the case, the lock, if in a locked position, must first be moved to an unlocked position. This ay be done with a key. Then, the latch portion 22 is moved to the second position by means of a force applied to the actuator portion 58. With this movement, not only is the catch engaging means 74 disengaged from the notch of the catch 28, but the catch releasing means 88 is brought to bear on the catch thereby tending to drive it out of the housing portion 20. Then the actuator can be released. Once the latch portion is released from the second position, the biasing means 24 will move the latch portion 22 back to the first position.

Figure 7:
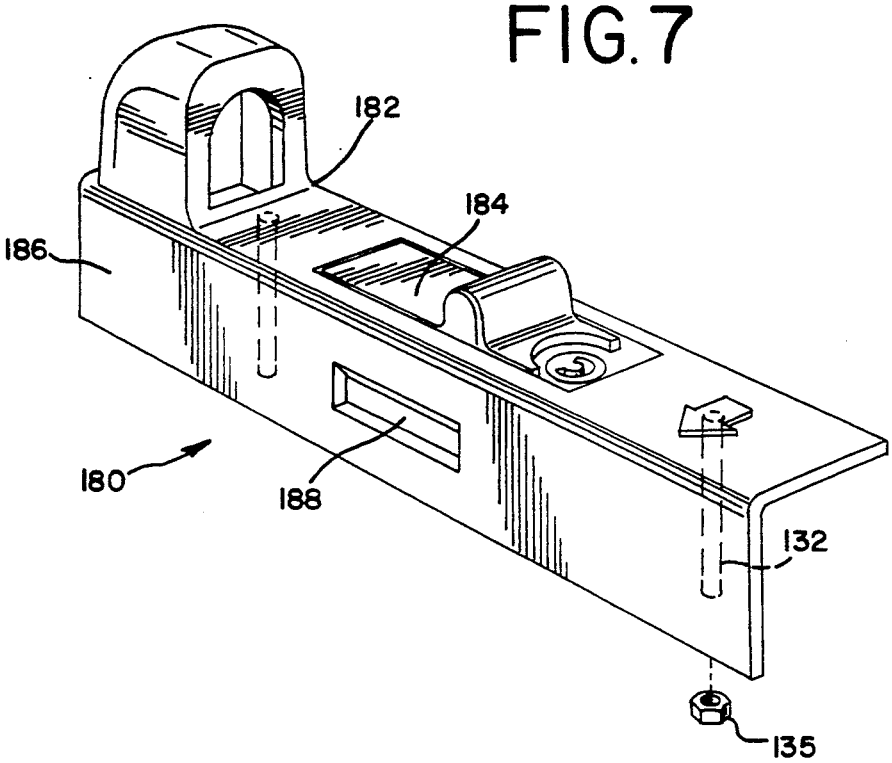
FIG. 7 is a perspective view of a second preferred embodiment of the present invention.

A second embodiment of the present invention is depicted in FIG. 7. In this embodiment, a sliding lock 180 is similar to construction to the sliding lock 10 of the first embodiment. The second embodiment 180 includes a housing portion 182 and a latch portion 184 biased by means of a biasing means (not shown) as in the first embodiment. The second embodiment further includes a housing skirt portion 186. The housing skirt 186 is preferably formed of part of the housing portion 182 and is sized and adapted to fit along a first edge of first part of a case (not shown). The housing skirt 186 will include a catch opening 188 located therein for the purpose of receiving a catch as in the first embodiment. Because of provision of the housing skirt 186, the housing portion 182 of this embodiment is not necessarily symmetrical about a longitudinal axis thereof.

Referring to FIG. 8, another preferred embodiment of the present invention is shown. In this embodiment, the present invention includes an elongate housing 190 which includes two latch chambers 192 and 194 therein. Into each of these two latch chambers 192 and 194 may be positioned a latch portion (not shown), biasing means (not shown), and lock (not shown). The elongate housing thus provides for two separate latches each associated with separate catches on an opposite case part. The two latch portions, biasing means, and locks function as in the previously described embodiments. The provision of two latches and associated catches is particularly suitable in application in which the case is relatively large and more than one sliding lock is indicated. The use of the elongate housing obviates the necessity for installing two separate housing portions into the case and thus provides for minimization of parts and costs of construction. In this embodiment, the elongate housing 190 includes an elongate connection member 196 positioned between and connecting those portions of the elongate housing 190 around each of the two latch chambers 192 and 194. In addition, on the upper side of the elongate member 196 there may be provided a handle lug 200. This handle lug 200 provides the same function as the handle lug 48 of the first described embodiment. In addition, a separate lug mounting means 202 may be provided at a location in the elongate member 196 several inches from the handle lug 200. This separate mounting means 202 may preferably include a shaft and post operable to engage a separate mounting lug 204.

From the foregoing it is evident that the claimed invention is a distinct and novel sliding latch lock presenting clear advantages over the prior inventions. It features a sliding latch, has a minimum number of parts and is easily assembled. It provides for an indexed lock and further may provide reversible utility so that the same design can be installed on both the left and right side of a case.

The above is a disclosure of the preferred embodiment of the invention presently contemplated. Various changes and modifications may be made by those skilled in the art without departing from the spirit of the invention.

I claim:

1. A sliding latch lock constructed from self-fastening members, designed for reversible utility allowing the sliding latch lock to be mounted on either a right hand side or a left hand side of a case having a first shell and a second shell, the sliding latch lock comprising:

a slide housing mounted to the first shell of the case;

a slide latch slidably self-fastened into the slide housing and movable to a latched position and an unlatched position;

a spring mounted between the slide housing and the slide latch to bias the slide latch to the latched position, a lock self-fastened into the slide housing and which interacts with the slide latch to provide indexed rotational movement of the lock, a catch which is mounted to the second shell of the case so when the catch is engaged by the slide latch in the slide housing the case will not open, wherein the slide latch is symmetrical about a longitudinal axis, the slide latch comprises a slide latch body, means for slidably securing the slide latch into the slide housing, means for rotationally securing the lock and means for engaging and disengaging the catch, said engaging and disengaging means being integral to the slide latch and comprises at least one slide latch engaging surface and at least one slide latch disengaging surface arranged so that when the slide latch engages the catch, the slide latch engaging surface contacts a catch engaging surface, when the slide latch is moved to disengage the catch, the slide latch engaging surface is withdrawn from contact with a catch engaging surface and the slide latch disengaging surface is brought into contact with a catch disengaging surface so as to force the catch out from the slide housing, and further when the slide latch is moved back to its engaged position after disengaging the catch, the slide latch disengaging surface is withdrawn from contact with a catch and the slide latch engaging surface is brought into contact with the catch disengaging surface to further force the catch out from the slide housing.

2. The device of claim 1 wherein the slide latch has lock support prongs and the lock is self-fastened into the slide housing by rotationally engaging the lock support prongs on the slide latch.

3. The device of claim 1 wherein the catch comprises a member having at least one catch engaging surface and at least one catch disengaging surface.

4. The device of claim 1 wherein the means for engaging the disengaging the catch are configured for reversible utility so that the sliding latch lock can be mounted in either the right hand side or left hand side position of the same shell of a case.

5. A sliding latch lock constructed from self-fastening members, designed for reversible utility allowing the sliding latch lock to be mounted on either a right hand side of a left hand side of a case having a first shell and a second shell, the sliding latch lock comprising:

a slide housing mounted to the first shell of the case, a slide latch slidably self-fastened into the slide housing and movable to a latched position and an unlatched position, a spring mounted between the slide housing and the slide latch to bias the slide latch to the latched position, and a lock self-fastened into the slide housing and which interacts with the slide latch to provide indexed rotational movement of the lock, the slide latch has lock support prongs and the lock is self-fastened into the slide housing by rotationally engaging the lock support prongs on the slide latch, the lock having an upper portion, middle portion and lower portion where the upper portion has a keyhole permitting rotation of the lock and further is substantially circular and has a circumferential securing skirt which interacts with the lock support prongs to keep the lock positioned in the slide housing, the middle portion has substantially square sides with beveled corners, where the square sides interact with the lock support prongs to provide an index to the lock, and the lower portion is substantially rectangular so that when the lock is rotated to a first position, the lower portion blocks the slide latch from sliding and when rotated to a second position it does not, and a catch which is mounted to the second shell of the case so when the catch is engaged by the slide latch in the slide housing the case will not open.

6. A sliding latch lock for an electronic equipment case having a first shell and a second shell and designed for reversible utility allowing the sliding latch lock to be mounted on either a right hand side or a left hand side of the electronic equipment case comprising:

a slide housing mounted to the first shell of a case, a slide latch slidably self-fastened into the slide housing, a spring mounted between the slide housing and the slide latch to bias the slide latch to a latched position, a lock self-fastened into the slide housing and which interacts with the slide latch to provide indexed rotational movement of the lock, a catch mounted to the second shell of the case so when the catch is engaged by the slide latch in the slide housing the case will not open, wherein the slide latch is symmetrical about a longitudinal axis, the slide latch comprises a slide latch body, means for slidably securing the slide latch into the slide housing, means for rotationally securing the lock and means for engaging and disengaging the catch, said engaging and disengaging means being integral to the slide latch and comprises at least one slide latch engaging surface and at least one slide latch disengaging surface arranged so that when the slide latch engages the catch, a slide latch engaging surface contacts a catch engaging surface, when the slide latch is moved to disengage the catch, a slide latch engaging surface is withdrawn from contact with a catch engaging surface and a slide latch disengaging surface is brought into contact with a catch disengaging surface so as to force the catch out from the slide housing, and further when the slide latch is moved back to its engaged position after disengaging the catch, a slide latch disengaging surface is withdrawn from contact with the catch and a slide latch engaging surface is brought into contact with the catch disengaging surface to further force the catch out from the slide housing.

7. The device of claim 6 wherein the slide latch has lock support prongs and the lock is self-fastened into the slide housing by rotationally engaging the lock support prongs on the slide latch.

8. The device of claim 6 wherein the catch comprises a member having at least one catch engaging surface and at least one catch disengaging surface.

9. The device of claim 6 wherein the means for engaging and disengaging the catch are configured for reversible utility so that the sliding latch lock can be mounted in either the right hand side or left hand side position of the same shell of a case.

10. A sliding latch lock for an electronic equipment case having a first shell and a second shell designed for reversible utility allowing the sliding latch lock to be mounted on either a right hand side or a left hand side or the electronic equipment case comprising:

a slide housing mounted to the first shell of a case, a slide latch slidably self-fastened into the slide housing, a spring mounted between the slide housing and the slide latch to bias the slide latch to a latched position, a lock self-fastened into the slide housing and which interacts with the slide latch to provide indexed rotational movement to the lock, the slide latch has lock support prongs and the lock is self-fastened into the slide housing by rotationally engaging the lock support prongs on the slide latch, the lock has an upper portion, a middle portion and lower portion where the upper portion has a keyhole permitting rotation of the lock and further is substantially circular and has a circumferential securing skirt which interacts at the lock support prongs to keep the lock positioned in the slide housing, the middle portion has substantially square sides with beveled corners, where the square sides interact with the lock support prongs to provide an index to the lock, and the lower portion is substantially rectangular so that when the lock is rotated to a first position, the lower portion blocks the slide latch from sliding and when rotated to a second position it does not, and a catch mounted to the second shell of the case so when the catch is engaged by the slide latch in the slide housing the case will not open.

11. An apparatus for locking a case having a first part and a second part that close together along a first edge of the first part and a second edge of the second part, comprising:

a housing portion mountable in the first part adjacent the first edge;

a latch portion positioned in said housing portion, said latch portion capable of slidable movement within said housing portion form a first position to a second position which is displaced from said first position;

a biasing means to bias said latch portion into said first position;

a catch connected to the second part of the case and extending in a direction form the second edge of the second part toward the first edge of the first part, and further in which said catch is positioned with respect to said housing portion and said latch portion in the first part so that when the first edge of the first part and the second edge of the second part are closed together and said latch portion is in said first position, said latch portion engages said catch;

wherein said latch portion further comprises catch engaging means positioned to engage said catch when said latch portion is in said first position and catch releasing means positioned to disengage said catch when said latch portion is moved from said first position to said second position.

12. An apparatus for locking a case having a first part and a second part that close together along a first edge of a first part and a second edge of the second part, comprising:

a housing portion mountable in the first part adjacent the first edge, a latch portion positioned in said housing portion, said latch portion capable of slidable movement within said housing portion from a first position to a second position which is displaced from said first position, said housing portion and said latch portion are symmetrical about a longitudinal axis of said housing portion, a biasing means to bias said latch portion into said first position, and a catch connected to the second part of the case and extending in a direction from the second edge of the second part toward the first edge of the first part, and further in which said catch is positioned with respect to said housing portion and said latch portion in the first part so that when the first edge of the first part and the second edge of the second part are closed together and said latch portion is in said first position, said latch portion engages said catch.

13. An apparatus for locking a case having a first part and a second part that close together along a first edge of a first part and a second edge of the second part, comprising:

an elongate housing portion having a longitudinal axis, said elongate housing being symmetrical about said axis and mountable in the first part adjacent the first edge;

a first latch portion positioned in said elongate housing portion, said first latch portion having a longitudinal axis, said first latch portion being symmetrical about said longitudinal axis, said longitudinal axis corresponding to the longitudinal axis of the elongate housing, said first latch portion capable of slidable sideways movement within said housing portion form a first positioned to a second position which is displaced form said first position along the longitudinal axis of the housing;

a first biasing means to bias said first latch portion into said first position;

a first catch connected tot he second part of the case and extending in a direction from the second edge of the second part toward the first edge of the first part, and further in which said first catch is positioned with respect to said elongate housing portion and said first latch portion in the first part so that when the first edge of the first part and the second edge of the second part are closed together and said first latch portion is in said first position said first latch portion engages said first catch;

a second latch portion positioned in said elongate housing portion, said second latch portion capable of slidable movement within said housing portion from a first position to a second position which is displaced from said first position;

a second biasing means to bias said second latch portion into said first position;

a second catch connected to the second part of the case and extending in a direction from the second edge of the second part toward the first edge of the first part, and further in which said second catch is positioned with respect to said elongate housing portion and said second latch portion in the first part so that when the first edge of the first part and the second edge of the second part are closed together and said second latch portion is in said first position, said second latch portion engages said second catch.

14. A method of installing into a case a locking apparatus suitable for locking the case, the case having a first part and a second part that close together along a first edge of the first part and a second edge of the second part, comprised of the steps of:

assembling a locking apparatus comprising the steps of:

snapping a latch portion and a biasing means into housing portion with the biasing means bearing upon a first surface of the housing portion and a first surface of the latch portion so that the latch portion is capable of slidable movement within the housing portion from a first position to a second position displaced from said first position; and assembling a lock into prongs of the latch portion; and fastening into an opening located in the first part of the case adjacent the first edge thereof the assembled locking apparatus; and installing into the second part a catch extending in a direction from the second edge of the second part toward the first edge of the first part, and further in which the catch is positioned, aligned, and adapted with respect to the housing portion and the latch portion in the first part so that when the first edge of the first part and the second edge of the second part are closed together and said latch portion is in the first position, the latch portion engages the catch.

15. The apparatus of claim 10 wherein a housing skirt engages into the first shell of the case when the sliding latch lock is mounted to the first shell and provides a surface upon which the second shell of the case engages when the case is closed.

* * * * *